US007449094B2

(12) United States Patent
Li-Ren

(10) Patent No.: US 7,449,094 B2
(45) Date of Patent: Nov. 11, 2008

(54) METHOD FOR FORMING PHOSPHOR LAYER ON SHADOW MASK OF PLASMA DISPLAY PANEL

(75) Inventor: Tsuei Li-Ren, Taipei County (TW)

(73) Assignee: Chunghwa Picture Tubes, Ltd., Taoyuan (TW)

( * ) Notice: Subject to any disclaimer, the term of this patent is extended or adjusted under 35 U.S.C. 154(b) by 934 days.

(21) Appl. No.: 10/904,949

(22) Filed: Dec. 7, 2004

(65) Prior Publication Data

US 2005/0266151 A1 Dec. 1, 2005

(30) Foreign Application Priority Data

May 25, 2004 (TW) ..... 93114737 A

(51) Int. Cl.
*C25D 13/02* (2006.01)

(52) U.S. Cl. ..... 204/485; 204/486; 204/487; 204/490; 204/491

(58) Field of Classification Search ..... 204/485, 204/486, 487, 490, 491
See application file for complete search history.

(56) References Cited

U.S. PATENT DOCUMENTS 6,627,060 B1 * 9/2003 Yum et al. ..... 204/478
2005/0218805 A1 * 10/2005 Kitagawa et al. ..... 313/582

FOREIGN PATENT DOCUMENTS

JP 09-202995 A * 8/1997

* cited by examiner

*Primary Examiner*—Kishor Mayekar
(74) *Attorney, Agent, or Firm*—Jianq Chyun IP Office

(57) ABSTRACT

A method of forming a phosphor layer on a shadow mask of a plasma display panel (PDP) is described. The shadow mask is bonded with a deposition mask such that predetermined apertures on the former are aligned with the openings on the latter and the other apertures blocked by the latter. The two masks are loaded into an electrophoretic cell, where a kind of phosphor is attracted by the shadow mask to pass through the openings on the deposition mask and deposit on the internal walls of the exposed apertures of the shadow mask. The phosphor layer is then dried to remove the solvent. By repeating the above steps with different kinds of phosphor, deposition masks and electrophoretic cells, phosphor layers of three different colors can be formed on the shadow mask for fabricating a full-color PDP.

30 Claims, 5 Drawing Sheets

METHOD FOR FORMING PHOSPHOR LAYER ON SHADOW MASK OF PLASMA DISPLAY PANEL

CROSS-REFERENCE TO RELATED APPLICATION

This application claims the priority benefit of Taiwan application serial no. 93114737, filed May 25, 2004.

BACKGROUND OF THE INVENTION

1. Field of the Invention

The present invention relates to a fabricating process of plasma display panel (PDP). More particularly, the present invention relates to a method for forming a phosphor layer on a shadow mask of a PDP utilizing electrophoretic deposition.

2. Description of the Related Art

Referring to FIG. 1, a PDP includes essentially a front substrate 11, a rear substrate 10 and a shadow mask 12 between the front and rear substrates 111 and 10. Each of the front and rear substrates 111 and 10 includes parallel electrodes and a dielectric layer 124 covering the electrodes, and the shadow mask 12 is a grid-like mask with regularly arranged apertures 13, wherein each aperture 13 defines a discharging unit between the front and rear substrates 111 and 10. A phosphor layer 123 is coated on four internal walls of each aperture 13 and the surface of the dielectric layer 124 exposed by the aperture 13 for emitting light.

The conventional method for forming the phosphor layer 123 is screen-printing. However, screen-printing is quite complicated and has the following drawbacks depending on the step sequence. If the shadow mask 12 is printed with the phosphor 123 before being fixed onto the rear substrate 10, the shadow mask 12 is difficult to immobilize as being printed. Meanwhile, since the apertures 13 on the shadow mask 12 are all through holes, the phosphor 123 at the bottoms of the apertures 13 easily falls off after the printing operation to cause the adjacent phosphor to peel off. If the shadow mask 12 is fixed onto the rear substrate 10 before being printed with the phosphor 123, the shadow mask 12 is also difficult to immobilize as being printed. Therefore, the shadow mask 12 is easily shifted as being printed to result in the color mixing problem. Moreover, the phosphor 123 cannot be printed uniformly onto the shadow mask 12.

In addition, because the phosphor for screen-printing is prepared in the form of slurry, a calcination step is required to remove the solvent from the slurry after the printing step. However, since the thermal expansion coefficients of the shadow mask 12 and the rear substrate 10 are different, a misalignment problem frequently occurs after the calcination step to lower the yield and increase the manufacturing cost.

SUMMARY OF THE INVENTION

Accordingly, this invention provides a method for forming a phosphor layer on a shadow mask of a PDP, wherein the phosphor layer is formed with uniform thickness and good adhesion without the color mixing problem.

This invention is also intended to omit the calcination step from the fabrication of PDP, so as to solve the misalignment problem in the prior art.

The method of forming a phosphor layer on a shadow mask of a PDP of this invention is described as follows. A deposition mask is mounted onto the shadow mask after the opposite side of the shadow mask is blocked, such that predetermined apertures on the shadow mask are aligned with the openings on the deposition mask and the other apertures blocked by the latter. The shadow mask and the deposition mask are then loaded into an electrophoretic cell, where a kind of phosphor is attracted by the shadow mask to pass through the openings on the deposition mask and deposit on the internal walls of the exposed apertures on the shadow mask. The phosphor layer is then dried to remove the solvent.

Accordingly, by performing the above steps three times with three different deposition masks and three kinds of phosphor of different colors, three phosphor layers of different colors can be easily formed on the shadow mask. Therefore, a full-color PDP can be fabricated in a simpler process with a lower cost.

With the above method, a phosphor layer can be formed with uniform thickness and good adhesion without the color mixing problem. Therefore, the image brightness and the color quality of the PDP can be improved effectively. Moreover, since the phosphor layer is formed with electrophoretic deposition, rather than with slurry coating, no high-temperature calcination is required for the phosphor layer. Therefore, the lifetime of the phosphor layer can be increased effectively, and the misalignment problem caused by the calcination step in the prior art can be prevented. Consequently, the process of forming phosphor layers on the shadow mask can be significantly simplified, and the yield of the product can be much increased to further reduce the manufacturing cost of PDP.

It is to be understood that both the foregoing general description and the following detailed description are exemplary, and are intended to provide further explanation of the invention as claimed.

DESCRIPTION OF THE PREFERRED EMBODIMENTS

Figure 1:
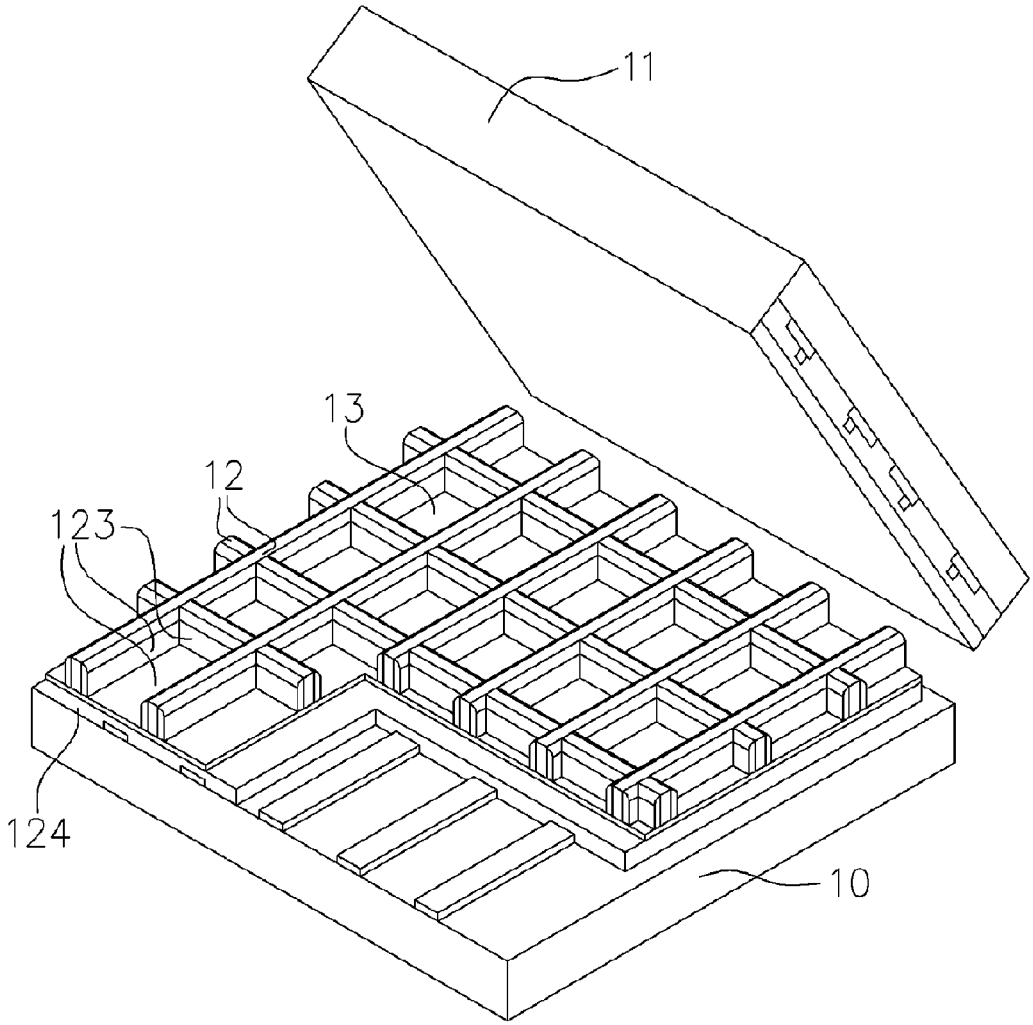
FIG. 1 (PRIOR ART)
FIG. 1 schematically illustrates the assembly of the shadow mask, the front substrate and the rear substrate of a PDP including a shadow mask in the prior art.
Figure 2:
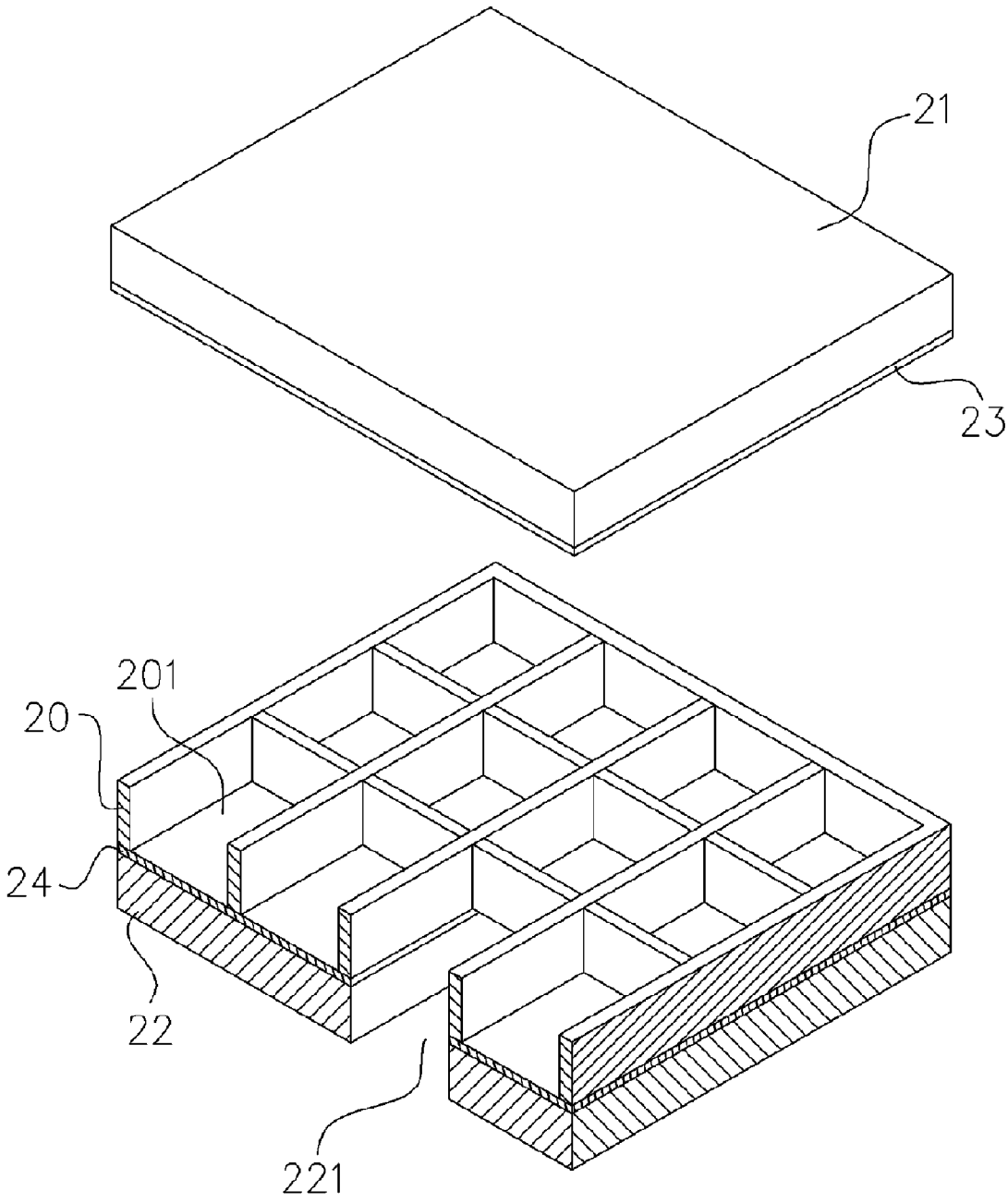
FIG. 2 schematically illustrates a shadow mask bonded with a shielding board and a deposition mask respectively on two sides thereof according to a preferred embodiment of this invention.

Referring to FIG. 2, the shadow mask 20 used in a PDP is usually a grid-like metal mask having multiple apertures 201 thereon, wherein the apertures 201 are formed with the same size and arranged regularly. The shadow mask 20 may be made from a magnetic metallic material, such as, iron (Fe), cobalt (Co), nickel (Ni) or an alloy thereof. After the shadow mask 20 is integrated with a front substrate and a rear substrate to form a PDP, the space surrounded by the internal walls of each aperture 201 acts as a discharging unit. As shown in FIG. 2, before the four internal walls of each selected aperture 201 are coated with a kind of phosphor, a shielding board 21 is mounted onto one side of the shadow mask 20 to block the same side of each aperture 201, and a deposition mask 22 is mounted onto the other side of the shadow mask 20. The deposition mask 22 has multiple openings 221 at specific locations, so that the apertures 201 predetermined to coat with phosphor of a specific color are exposed after the deposition mask 22 is mounted onto the shadow mask 20. The apertures 201 predetermined to coat with phosphor of the other colors are blocked by the deposition mask 22 to form closed spaces. The deposition mask 22 may also be made from a magnetic metallic material, such as, iron (Fe), cobalt (Co), nickel (Ni) or an alloy thereof, and the materials of the shadow mask 20 and the deposition mask 22 may be the same or different.

The shielding board 21 is preferably made from a material capable of producing magnetism when the deposition mask 22 is made from a magnetic metallic material or when both the shadow mask 20 and the deposition mask 22 are made from magnetic metallic material. When the deposition mask 22 is made from a magnetic metallic material but the shadow mask 20 is not, the shadow mask 20 can be held between the shielding board 21 and the deposition mask 22 through the magnetic attraction between the two. When both the shadow mask 20 and the deposition mask 22 are made from a magnetic metallic material, the shadow mask 20 is magnetically bonded with the shielding board 21, and the deposition mask 22 is magnetically bonded with the shadow mask 20 that is magnetized by the shielding board 21. Such a shielding board 21 not only blocks one side of the shadow mask 20, but also serves to bond the shadow mask 20 and the deposition mask 22 together. Accordingly, the shielding board 21 itself may be an electromagnet.

Moreover, when the shielding board 21 and/or the deposition mask 22 is made from a magnetic material or a material on which magnetism can be induced, the shielding board 21 and/or the deposition mask 22 can be directly mounted onto the shadow mask 20 and rapidly removed after use. However, when the deposition mask 22/shielding board 21 is made from an electrically conductive magnetic material, an insulating film 24/23 having openings at corresponding positions is preferably inserted between the shadow mask 20 and the deposition mask 22/shielding board 21. If the insulating film 24/23 is absent, the voltage applied to the shadow mask 20 will be transmitted to the deposition mask 22/shielding board 21 so that much phosphor is deposited on the surface of the deposition mask 22/shielding board 21 to cause undesired consumption of the phosphor.

Figure 3:
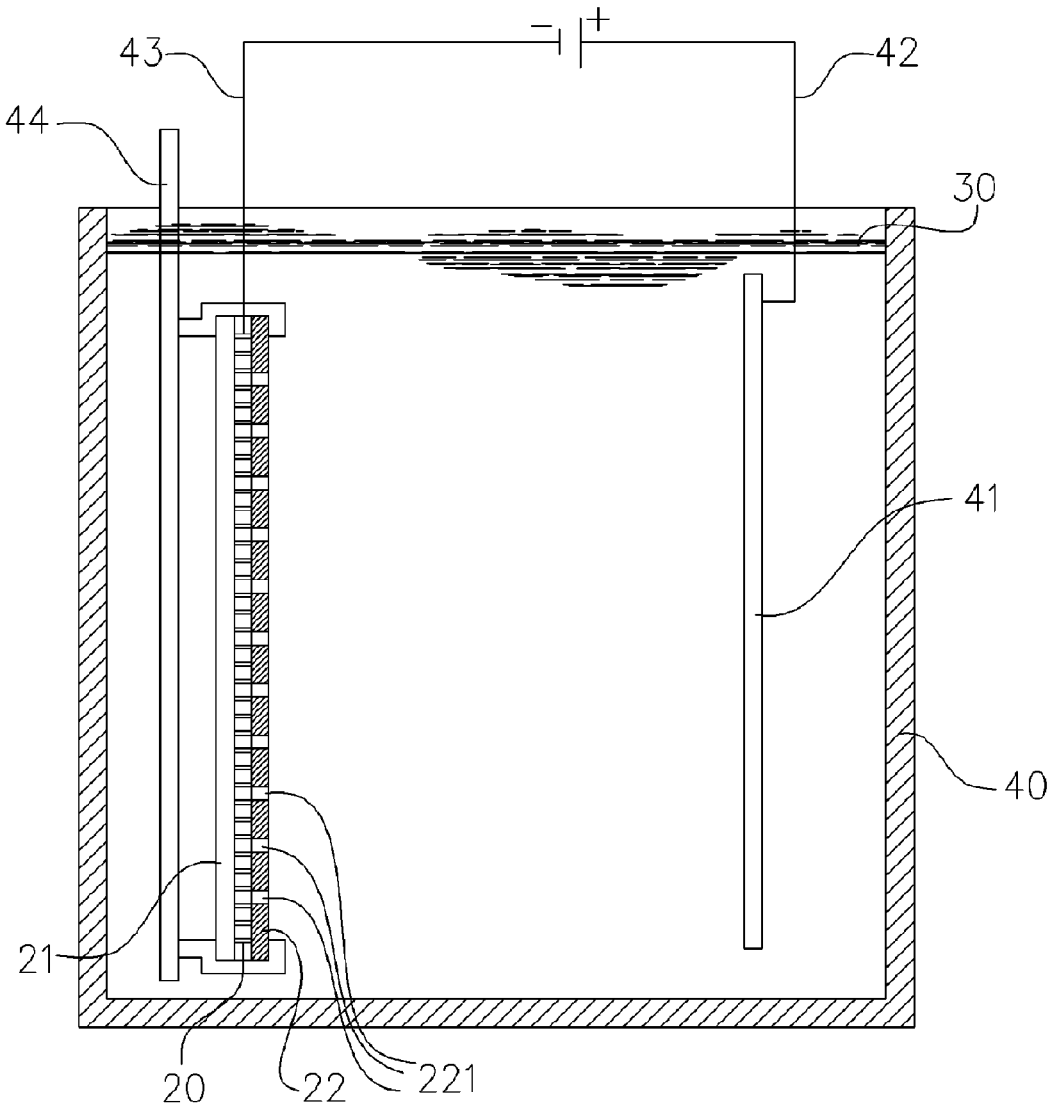
FIG. 3 schematically illustrates the structure of the electrophoretic cell used for depositing a kind of phosphor on the shadow mask according to the preferred embodiment of this invention.

Referring to FIG. 3, the electrophoretic deposition process used here is described as follows. A kind of phosphor and an electrolyte of moderate amounts are well mixed in a solvent, and the mixture is well stirred into an electrophoretic solution 30. Examples of red phosphor include $(YGd)BO_3$:Eu, $(Y.Gd, Eu)_2O_3$, $Y_2O_3$:Eu and combinations thereof, etc. Examples of green phosphor include $Zn_2SiO_4$:Mn, $BaAi_2O_9$:Mn and a combination thereof, etc. Examples of blue phosphor include $BaMgAl_{10}O_{17}$:Eu. The solvent may be a non-aqueous solvent, such as, isopropyl alcohol (IPA), acetone, benzene, toluene or a combination thereof, and the electrolyte is a cationic or anionic surfactant that can be dissolved in the solvent, such as, magnesium nitrate ($Mg(NO_3)_2$). The weight ratio of the phosphor to the electrolyte ranges from 10 to 1000, and the ratio of the volume (ml) of the solvent to the amount (g) of the phosphor ranges from 80-80000.

The electrophoretic solution 30 can be prepared by mixing a solution (A) containing a solvent and the phosphor and a solution (B) containing the solvent and the electrolyte and then well stirring the mixture. The mixture is well stirred in a rate of 50-1000 rpm for 1 min-72 hr, depending on practical requirements. The electrophoretic solution 30 is transferred to an electrophoretic cell 40, and then a clamp 44 is used to hold the above composite including the shadow mask 20 and immerse the same into the electrophoretic solution 30. Thereafter, an electrophoretic deposition step is implemented by applying a voltage difference between the shadow mask 20 and a counter electrode 41 via lines 42 and 43, wherein the counter electrode is also immersed in the electrophoretic solution 30. The voltage difference is applied such that the charged phosphor in the electrophoretic solution 30 is attracted by the shadow mask 20 to pass through the openings 221 on the deposition mask 22 and uniformly deposit on the internal walls of the exposed apertures 201 on the shadow mask 20. The resulting electric field between the shadow mask 20 and the counter electrode 41 ranges from 1 V/cm to 1000V/cm, for example, depending on practical requirements.

Figure 4:
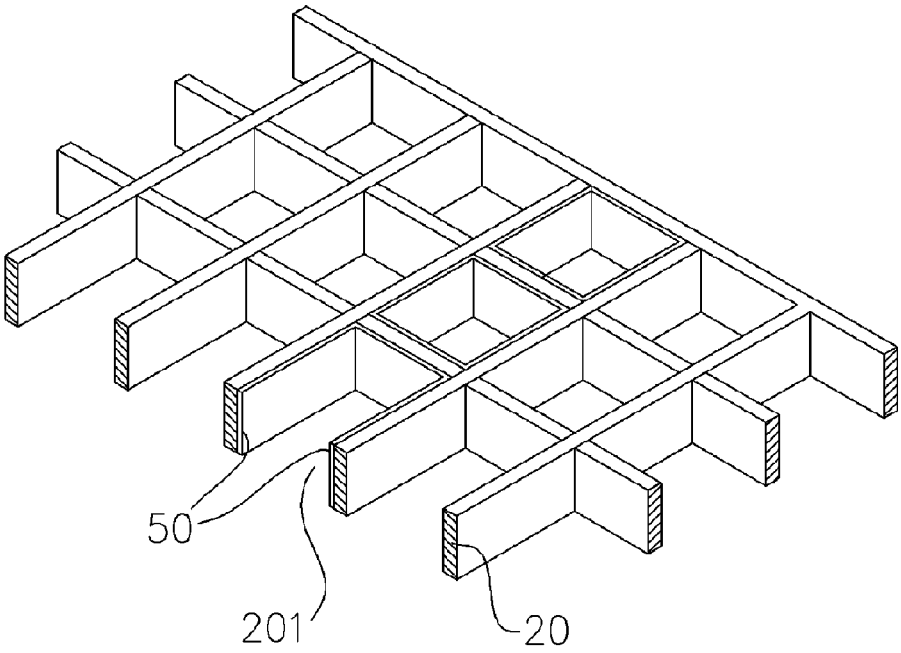
FIG. 4 schematically illustrates a perspective view of the shadow mask after the first electrophoretic deposition step according to the preferred embodiment of this invention.

After the electrophoretic deposition step is continued for a certain period, for example, 1 sec-24 hr, the shadow mask 20 is taken out of the electrophoretic cell 40 and then dried. The drying temperature ranges from 25° C. to 500° C., the drying time is 10 sec-24 hr, and the heating rate at the beginning of the drying step ranges from 0.1° C./min to 30° C./min. With the above steps, a phosphor layer 50 of a predetermined color can be formed on the internal walls of each exposed aperture 201 with uniform thickness and good adhesion, as shown in FIG. 4.

Figure 5:
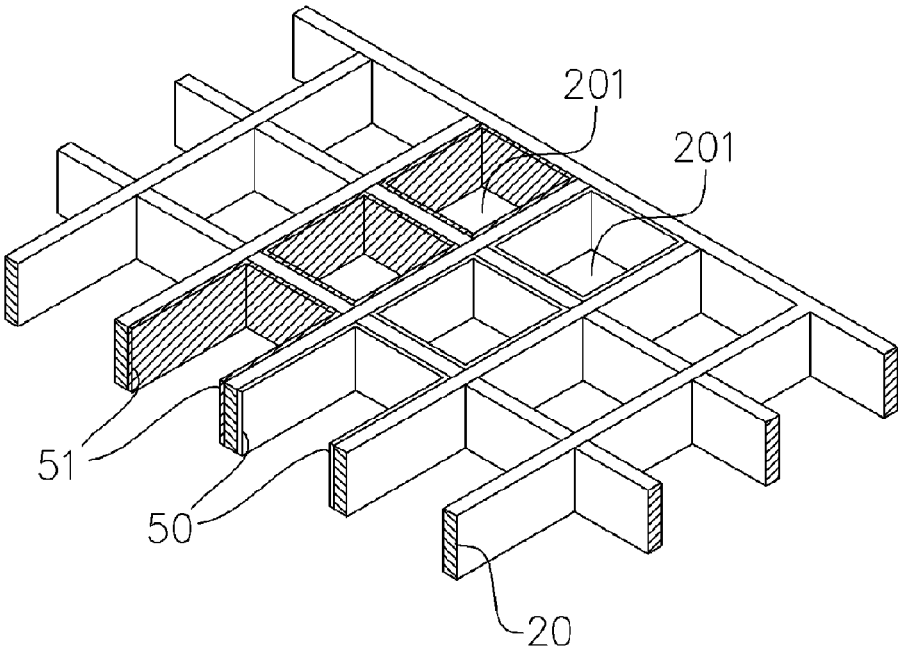
FIG. 5 schematically illustrates a perspective view of the above shadow mask after the second electrophoretic deposition step.

After the phosphor layer 50 of a first color is formed, another deposition mask with openings at different positions can be used to select the apertures predetermined to coat with phosphor of a second color. The above steps are then repeated to implement another electrophoretic deposition process, so as form a phosphor layer 71 of the second color on the internal walls of each selected aperture 201, as shown in FIG. 5. Accordingly, by repeating the above steps with different kinds of phosphor, deposition masks and electrophoretic cells, phosphor layers of three different colors can be formed on the shadow mask 20 for fabricating a full-color PDP.

Figure 6:
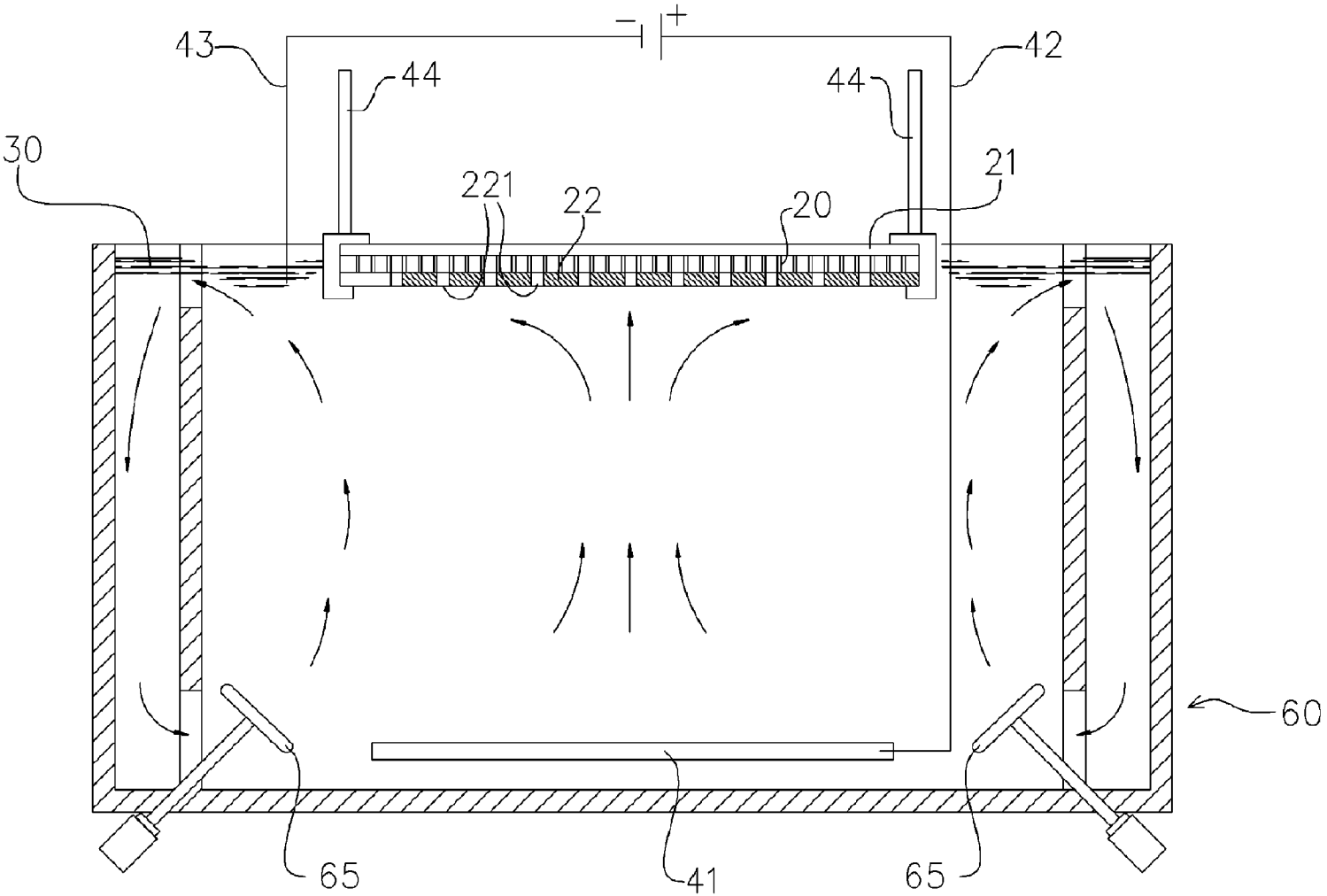
FIG. 6 schematically illustrates the structure of the electrophoretic cell used for depositing a kind of phosphor on the shadow mask according to another preferred embodiment of this invention.

In another preferred embodiment, the above composite including the shadow mask is placed horizontally to simplify the fabrication of phosphor layers on the shadow mask as well as to make the thickness of the same more uniform. As shown in FIG. 6, the shadow mask 20 is placed in an electrophoretic cell 60 such that the shielding board 21 is away from the electrophoretic solution 30. Then, an electrophoretic deposition step is implemented by applying a voltage difference between the shadow mask 20 and an counter electrode 41 via lines 42 and 43, wherein the counter electrode 41 is immersed in the electrophoretic solution 30. Stirrers 65 are also used to stir up the electrophoretic solution 30 in the electrophoretic cell 60, so as to make the phosphor distribute evenly in the electrophoretic solution 30.

The voltage difference is applied such that the charged phosphor in the electrophoretic solution 30 is attracted by the shadow mask 20 to pass through the openings 221 on the deposition mask 22 and uniformly deposit on the internal walls of the exposed apertures 201 on the shadow mask 20. After the electrophoretic deposition step is continued for a certain period, the shadow mask 20 is taken out of the electrophoretic cell 60 and then dried. With the above steps, a phosphor layer of a predetermined color can be formed on the internal walls of each aperture 201 with more uniform thickness and good adhesion.

EXAMPLE

In this example, a kind of phosphor of 2.4 g is added into 400 ml of isopropyl alcohol (IPA), and the mixture is stirred in a rate of 200 rpm for 30 min to prepare a solution (A). A solution (B) is prepared by adding 0.024 g of magnesium nitrate ($Mg(NO_3)_2$) into 400 ml of IPA and stirring the mixture in a rate of 200 rpm for 1 min. Thereafter, the solution (B) is added into the solution (A), and the mixture is stirred in a rate of 200 rpm for 17.5 hr. The solution is then transferred into an electrophoretic cell. A deposition mask is fixed onto the shadow mask with a clamp, and the shadow mask with the deposition mask is immersed into the above solution contained in the electrophoretic cell.

In the electrophoretic deposition process, the voltage difference between the shadow mask and the electrode is 300V, and the distance between them is 1 cm. Accordingly, the electric field between the shadow mask and the electrode is 300V/cm. The deposition process is conducted for 10 min, and then the shadow mask is taken out of the electrophoretic cell and dried. In the drying step, the shadow is firstly heated to 150° C. with a heating rate of 10° C./min and then kept under the same temperature for 10 min. With the above step, phosphor of a specific color is obtained with uniform thickness and good adhesion.

Since this invention utilizes an electrophoretic deposition method to form a phosphor layer on the shadow mask, immobilizing the deposition mask to the shadow mask is easy, and the phosphor layer can be formed with uniform thickness and good adhesion without the color mixing problem. Therefore, the image brightness and the color quality of the PDP can be improved effectively. Moreover, since the phosphor layer is formed with electrophoretic deposition, rather than with slurry coating, no high-temperature calcination step is required for the phosphor layer. Therefore, the misalignment problem resulting from the calcination in the prior art can be prevented. Consequently, the process of forming the phosphor layers on the shadow mask can be significantly simplified, and the yield of the product can be much increased to further reduce the manufacturing cost of PDP.

It will be apparent to those skilled in the art that various modifications and variations can be made to the structure of the present invention without departing from the scope or spirit of the invention. In view of the foregoing, it is intended that the present invention covers modifications and variations of this invention provided they fall within the scope of the following claims and their equivalents.

What is claimed is:

1. A method for forming a phosphor layer on a shadow mask of a plasma display panel, wherein the shadow mask has apertures thereon, the method comprising:

blocking one side of each aperture on the shadow mask;

exposing the other side of selected apertures on the shadow mask but blocking the other side of unselected apertures on the shadow mask; and depositing a phosphor layer on internal walls of each selected aperture on the shadow mask through electrophoretic deposition.

2. The method of claim 1, further comprising drying the phosphor layer.

3. A method for forming a phosphor layer on a shadow mask of a plasma display panel, wherein the shadow mask is electrically conductive and having a plurality of apertures thereon, the method comprising:

mounting a shielding board to one side of the shadow mask to block the same side of the apertures on the shadow mask;

mounting a deposition mask to the other side of the shadow mask, the deposition mask having a plurality of openings thereon aligned with selected apertures on the shadow mask;

immersing the shadow mask, the shielding board and the deposition mask into an electrophoretic solution containing a kind of charged phosphor; and applying a voltage difference between the shadow mask and a counter electrode to render the charged phosphor passing through the openings on the deposition mask and depositing in the exposed apertures on the shadow mask.

4. The method of claim 3, further comprising drying the phosphor layer.

5. The method of claim 4, wherein the phosphor layer is dried under 25-500° C. for 10 sec-24 hr.

6. The method of claim 5, wherein a heating rate at the beginning of the drying step ranges from 0.1° C./min to 30° C./min.

7. The method of claim 3, wherein the shadow mask comprises a metallic material.

8. The method of claim 7, wherein the shadow mask comprises a magnetic metallic material and the shielding board comprises a material capable of producing magnetism.

9. The method of claim 8, wherein an insulating layer is disposed between the shadow mask and the shielding board.

10. The method of claim 8, wherein the shadow mask comprises iron (Fe), cobalt (Co), nickel (Ni) or an alloy thereof.

11. The method of claim 8, wherein the deposition mask comprises a magnetic metallic material, and the deposition mask is magnetically bonded to the shadow mask that is magnetized by the shielding board.

12. The method of claim 11, wherein an insulating layer is disposed between the shadow mask and the deposition mask.

13. The method of claim 11, wherein the deposition mask comprises iron (Fe), cobalt (Co), nickel (Ni) or an alloy thereof.

14. The method of claim 11, wherein the shadow mask and the deposition mask comprise the same magnetic metallic material.

15. The method of claim 8, wherein the shielding board comprises an electromagnet.

16. The method of claim 3, wherein the shielding board comprises a material capable of producing magnetism, the deposition mask comprises a magnetic metallic material, and the shadow mask is held between the shielding board and the deposition mask through their magnetic attraction.

17. The method of claim 16, wherein the shielding board comprises an electromagnet.

18. The method of claim 16, wherein an insulating layer is disposed between the shadow mask and the deposition mask and another insulating layer is disposed between the shadow mask and the shielding board.

19. The method of claim 3, wherein the shadow mask is placed horizontally such that the shielding board is away from the electrophoretic solution.

20. The method of claim 3, wherein the phosphor is a kind of red phosphor selected from the group consisting of (Y.Gd) $BO_3$:Eu, $(Y.Gd,Eu)_2O_3$, $Y_2O_3$:Eu and combinations thereof.

21. The method of claim 3, wherein the phosphor is a kind of green phosphor selected from the group consisting of $Zn_2SiO_4$:Mn, $BaAI_{12}O_{19}$:Mn and a combination thereof.

22. The method of claim 3, wherein the phosphor is a kind of blue phosphor comprising $BaMgAl_{10}O_{17}$:Eu.

23. The method of claim 3, wherein the electrophoretic solution contains an electrolyte and the phosphor, and the weight ratio of the phosphor to the electrolyte ranges from 10 to 1000.

24. The method of claim 3, wherein the electrophoretic solution contains a non-aqueous solvent.

25. The method of claim 24, wherein the non-aqueous solvent is selected from the group consisting of isopropyl alcohol (IPA), acetone, benzene, toluene and combinations thereof.

26. The method of claim 3, wherein the electrophoretic solution contains an electrolyte that comprises a cationic or anionic surfactant.

27. The method of claim 26, wherein the electrolyte comprises magnesium nitrate ($Mg(NO_3)_2$).

28. The method of claim 3, wherein the electrophoretic solution contains a non-aqueous solvent and the phosphor, and the ratio of the volume (ml) of the non-aqueous solvent to the amount (g) of the phosphor ranges from 80-80000.

29. The method of claim 3, wherein an electric field between the shadow mask and the second electrode ranges from 1 to 1000V/cm.

30. The method of claim 3, wherein the phosphor deposition is performed for 1 sec-24 hr.

* * * * *